US010945485B2

(12) United States Patent
Wills

(10) Patent No.: US 10,945,485 B2
(45) **Date of Patent: *Mar. 16, 2021**

(54) HEELING APPARATUS

(71) Applicant: Heeling Sports Limited, Carrollton, TX (US)

(72) Inventor: Ryan D. Wills, Carrollton, TX (US)

(73) Assignee: HEELING SPORTS LIMITED, Carrollton, TX (US)

( * ) Notice: Subject to any disclaimer, the term of this patent is extended or adjusted under 35 U.S.C. 154(b) by 91 days.

This patent is subject to a terminal disclaimer.

(21) Appl. No.: 13/666,660

(22) Filed: Nov. 1, 2012

(65) Prior Publication Data

US 2014/0033573 A1 Feb. 6, 2014

Related U.S. Application Data

(60) Provisional application No. 61/679,445, filed on Aug. 3, 2012.

(51) Int. Cl.
*A43B 3/24* (2006.01)
*A43B 5/16* (2006.01)

(52) U.S. Cl.
CPC ..... *A43B 3/246* (2013.01); *A43B 5/1641* (2013.01)

(58) Field of Classification Search
CPC ..... A43B 3/0047; A43B 3/0042; A43B 3/244; A43B 5/1633; A43B 5/1641; A43B 5/16; A43B 13/14; A63C 17/1463; A63C 17/14
USPC ..... 36/100, 115, 3 R, 103, 101, 134; 280/841, 11.204
See application file for complete search history.

(56) References Cited

U.S. PATENT DOCUMENTS

| | | | |
|---|---|---|---|
| 132,474 | A | 10/1872 | Lindley |
| 202,191 | A | 4/1878 | Proctor |
| 234,030 | A | 11/1880 | Hadley et al. |
| 487,779 | A | 12/1892 | Schoen |
| 508,617 | A | 11/1893 | Hoerle |
| 579,577 | A | 3/1897 | Hanscom |
| 702,476 | A | 6/1902 | Price |
| 875,560 | A | 12/1907 | Vaughan |
| 881,079 | A | 3/1908 | Jolitz |
| 892,152 | A | 6/1908 | Harman |
| 966,821 | A | 8/1910 | Gaw |
| 968,020 | A | 8/1910 | Yandoll |
| 1,051,880 | A | 2/1913 | Glenn |
| 1,056,091 | A | 3/1913 | Dickson |

(Continued)

FOREIGN PATENT DOCUMENTS

| | | |
|---|---|---|
| AU | 137579 | 6/1999 |
| BR | 9506566-0 | 9/1997 |

(Continued)

*Primary Examiner* — Jillian K Pierorazio
(74) *Attorney, Agent, or Firm* — Locke Lord LLP; Scott D. Wofsy

(57) ABSTRACT

Provided is a heeling apparatus including an inner shell and an outer shell. The outer shell is configured to interlock with the inner shell. In one embodiment, the inner shell includes a plurality of protrusions configured to interlock with receiving apertures in the outer shell. In one embodiment, the inner shell includes a cavity configured to receive a removable bracket. The bracket includes a mounting assembly configured to receive a wheel assembly. The bracket is held in place by the interlocked relationship of the inner shell and the outer shell.

14 Claims, 15 Drawing Sheets

(56) References Cited

U.S. PATENT DOCUMENTS 1,068,575 A 7/1913 Demorey et al.
1,154,370 A 9/1915 Burke
1,189,329 A 7/1916 Winagle
1,260,901 A 3/1918 Hayhurst
1,369,849 A 3/1921 Spencer
1,428,232 A 9/1922 Holmen
1,468,682 A 9/1923 Wallace
1,478,587 A 12/1923 Stoner
1,502,087 A 7/1924 Bums
1,592,692 A 7/1926 Hackett
1,600,075 A 9/1926 Stoops
1,608,368 A 11/1926 Bugg
1,633,272 A 6/1927 Pribil
1,636,909 A 7/1927 Haney
1,690,696 A 11/1928 Norwood
1,702,591 A 2/1929 Brown
1,711,451 A 4/1929 Gibson
1,751,942 A 3/1930 Nanz
1,866,006 A 7/1932 Bergstrand
1,888,617 A 11/1932 Bridi
1,975,661 A 10/1934 Powell
1,984,989 A 12/1934 Reed
1,998,624 A 4/1935 Hughes
2,000,396 A 5/1935 Keller
2,060,391 A 11/1936 Castagnola
2,095,942 A 10/1937 Wetterstrand
2,113,477 A 4/1938 Gilman
2,114,461 A 4/1938 Agosta et al.
2,114,791 A 4/1938 Venables
2,138,823 A 12/1938 Werkman
2,165,581 A 7/1939 Schroeder
D117,918 S 12/1939 Brodick
D146,368 S 2/1947 McCaffrey
2,422,228 A 6/1947 Ferrar
2,466,611 A 4/1949 Nicoletti
2,476,806 A 7/1949 Brandt, Jr.
2,484,935 A 10/1949 De Rooy
2,490,469 A 12/1949 Pittman
2,505,154 A 4/1950 Smith
2,526,548 A 10/1950 Franklin
D161,557 S 1/1951 Walker et al.
2,572,671 A 10/1951 Shaw
2,582,551 A 1/1952 Malherbe
2,632,964 A 3/1953 Kriegel
2,669,038 A 2/1954 De Werth
2,721,400 A 10/1955 Israel
2,723,467 A 11/1955 Cassidy
2,897,609 A 8/1959 Bodkin
3,010,732 A 11/1961 Correll
3,027,661 A 4/1962 McCord
3,032,894 A 5/1962 Kennedy et al.
3,112,119 A 11/1963 Sweet
3,176,416 A 4/1965 Seegert
3,281,971 A 11/1966 Weitzner
3,306,623 A 2/1967 Weitzner
3,351,353 A 11/1967 Weitzner
3,374,002 A 3/1968 Lewis
3,476,399 A 11/1969 Finn
3,478,447 A 11/1969 Gillead
3,486,250 A 12/1969 Purtle
3,526,976 A * 9/1970 Jacobs ..... A43B 5/1633
280/11.3
3,665,621 A 5/1972 Massella
3,789,523 A 2/1974 Rubin
D231,999 S 7/1974 Engman
D233,619 S 11/1974 Kelling
3,876,217 A 4/1975 Copier
3,884,485 A 5/1975 Walle
3,934,359 A 1/1976 Fletcher
3,963,251 A 6/1976 Miano
3,979,842 A 9/1976 Texidor
3,983,643 A 10/1976 Schreyer et al.
3,997,179 A 12/1976 de Blois
4,034,995 A 7/1977 Forward et al.
4,076,263 A 2/1978 Rand
4,088,334 A 5/1978 Johnson
4,095,817 A 6/1978 Cohen
D250,492 S 12/1978 Kish
4,133,548 A 1/1979 Smith
4,138,127 A 2/1979 Kimmell et al.
4,149,735 A 4/1979 Blackburn et al.
4,150,497 A 4/1979 Weber
4,183,547 A 1/1980 Cohen et al.
4,214,384 A 7/1980 Gonzalez R.
4,219,240 A 8/1980 Brandenstein et al.
4,223,457 A 9/1980 Borgeas
4,245,406 A 1/1981 Landay et al.
4,262,433 A 4/1981 Hagg et al.
4,295,655 A 10/1981 Landay et al.
4,298,209 A 11/1981 Peters
4,298,910 A 11/1981 Price
4,303,253 A 12/1981 Rottenkolber
4,316,334 A 2/1982 Hunt
4,333,249 A 6/1982 Schaefer
4,342,158 A 8/1982 McMahon et al.
4,363,502 A 12/1982 Bakerman
4,364,187 A 12/1982 Melendez
4,412,685 A 11/1983 Szamek
4,417,737 A 11/1983 Suroff
4,442,614 A 4/1984 Farberov
4,492,046 A 1/1985 Kosova
4,496,025 A 1/1985 Gattman
4,523,767 A 6/1985 LePage
4,638,575 A 1/1987 Illustrato
4,648,610 A 3/1987 Hegyi
4,676,010 A 6/1987 Cheskin
4,691,453 A 9/1987 Tifre
4,699,390 A 10/1987 Cote
4,709,937 A 12/1987 Lin et al.
4,763,909 A 8/1988 Bergeron
4,775,919 A 10/1988 Pearsall et al.
4,783,910 A 11/1988 Boys, II et al.
4,795,181 A 1/1989 Armstrong
4,815,221 A 3/1989 Diaz
4,817,974 A 4/1989 Bergeron
4,841,648 A 6/1989 Shaffer et al.
4,843,737 A 7/1989 Vorderer
4,843,741 A 7/1989 Yung-Mao
D302,994 S 8/1989 Hawkes et al.
4,887,824 A 12/1989 Zatlin
4,897,939 A 2/1990 Harrington
4,928,982 A 5/1990 Logan
4,947,560 A 8/1990 Fuerst et al.
4,977,691 A 12/1990 Orchard, 3rd
4,988,122 A 1/1991 Saunders
4,995,173 A 2/1991 Spier
5,005,300 A 4/1991 Diaz et al.
5,046,746 A 9/1991 Gierveld
5,056,240 A 10/1991 Sherrill
5,060,401 A 10/1991 Whatley
5,134,791 A 8/1992 Gregory
5,195,257 A 3/1993 Holcomb et al.
5,224,278 A 7/1993 Jeon
5,232,231 A 8/1993 Carlsmith
5,236,224 A 8/1993 Anderson et al.
5,249,376 A 10/1993 Capria
D341,179 S 11/1993 Evans, III
5,282,325 A 2/1994 Beyl
5,286,043 A 2/1994 Tkaczyk
5,319,866 A 6/1994 Foley et al.
5,319,869 A 6/1994 McDonald et al.
D352,818 S 11/1994 Bailey
5,363,570 A 11/1994 Allen et al.
5,372,383 A 12/1994 Kubierschky
5,373,649 A 12/1994 Choi
5,381,608 A 1/1995 Claveria
5,384,973 A 1/1995 Lyden
5,388,350 A 2/1995 Parker, Jr.
5,392,537 A 2/1995 Goldberg
5,393,077 A 2/1995 Wanous
5,396,675 A 3/1995 Vincent et al.
5,398,949 A 3/1995 Tarng
5,398,970 A 3/1995 Tucky
5,410,821 A 5/1995 Hilgendorf

(56) References Cited

U.S. PATENT DOCUMENTS 5,417,444 A 5/1995 Chen
5,419,060 A 5/1995 Choi
5,425,186 A 6/1995 Hoyt
5,446,977 A * 9/1995 Nagano ..... A43B 5/14 36/131
5,456,478 A 10/1995 Hsu et al.
5,469,642 A 11/1995 Farbman
5,475,572 A 12/1995 Tseng
5,502,901 A 4/1996 Brown
5,511,824 A 4/1996 Kim
5,519,950 A 5/1996 Wang
5,527,049 A 6/1996 Ortiz
5,527,050 A 6/1996 Szendel
5,544,431 A 8/1996 Dixon
D373,674 S 9/1996 Dolinsky
5,552,972 A 9/1996 Rezvani
5,560,126 A 10/1996 Meschan et al.
5,566,958 A 10/1996 Sinelnikov et al.
5,572,804 A 11/1996 Skaja et al.
5,580,093 A 12/1996 Conway
5,586,777 A 12/1996 Wolf
5,595,004 A 1/1997 Lyden et al.
5,628,129 A * 5/1997 Kilgore ..... A43C 13/04 36/126
5,632,104 A 5/1997 Zohar
5,638,614 A 6/1997 Hardy
5,649,374 A 7/1997 Chou
5,649,716 A 7/1997 Zhang
5,655,316 A 8/1997 Huang
5,682,685 A 11/1997 Terlizzi
5,692,322 A 12/1997 Lombardino
5,697,643 A 12/1997 Marasco et al.
5,716,074 A 2/1998 Theodorou
5,716,723 A 2/1998 Van Cleef et al.
5,718,499 A 2/1998 De Caro
5,730,467 A 3/1998 Huang
5,743,028 A 4/1998 Lombardino
5,769,432 A 6/1998 Tybinkowski et al.
5,785,327 A 7/1998 Gallant
5,787,609 A 8/1998 Wu
5,797,609 A 8/1998 Fichepain
5,806,959 A 9/1998 Adams et al.
5,810,450 A 9/1998 Tsu et al.
5,823,913 A 10/1998 Aruin et al.
5,836,591 A 11/1998 Roderick et al.
5,839,737 A 11/1998 Kruczek
5,839,814 A 11/1998 Roberts
D401,739 S 12/1998 James
D402,797 S 12/1998 Kracke
D404,550 S 1/1999 James
5,855,382 A 1/1999 Reilly et al.
5,881,413 A 3/1999 Throneburg et al.
5,882,018 A 3/1999 Petrosino
5,885,500 A 3/1999 Tawney et al.
5,887,898 A 3/1999 Petrosino
D408,123 S 4/1999 James
5,927,729 A 7/1999 Di Filippo et al.
5,927,734 A 7/1999 Horton, II et al.
D412,778 S 8/1999 James
D412,779 S 8/1999 James
D413,193 S 8/1999 James
5,930,918 A 8/1999 Healy et al.
D414,021 S 9/1999 James
D414,320 S 9/1999 James
5,947,486 A 9/1999 Zell
5,951,049 A 9/1999 Calverey et al.
5,954,366 A 9/1999 Forman
5,957,541 A 9/1999 Seigler
5,967,552 A 10/1999 Roderick et al.
5,970,631 A 10/1999 Inman
5,979,992 A 11/1999 Calderone et al.
5,988,656 A 11/1999 Krah
5,997,105 A 12/1999 Wu
6,006,449 A 12/1999 Orlowski et al.
6,006,450 A 12/1999 Hayes
6,006,451 A 12/1999 Morris et al.
D420,789 S 2/2000 James
6,036,278 A 3/2000 Boyer
6,041,525 A 3/2000 Kelley
6,042,125 A 3/2000 Wu
6,050,357 A 4/2000 Staelin et al.
6,055,747 A 5/2000 Lombardino
6,061,930 A 5/2000 Zinovieff
D426,374 S 6/2000 Kelley
D426,948 S 6/2000 James
6,070,887 A 6/2000 Cornelius et al.
6,070,997 A 6/2000 Duke et al.
6,086,072 A 7/2000 Prus
6,092,305 A 7/2000 Troy et al.
6,113,123 A * 9/2000 Cabanis ..... A43B 5/1625 280/841
6,115,943 A 9/2000 Gyr
6,115,946 A 9/2000 Morris et al.
6,116,763 A 9/2000 King
6,120,039 A 9/2000 Clementi
6,132,006 A 10/2000 Post
D433,214 S 11/2000 McDowell
6,151,806 A 11/2000 Morris et al.
6,158,150 A 12/2000 Morris et al.
6,170,837 B1 1/2001 Ross
6,195,918 B1 3/2001 Kelley et al.
6,195,920 B1 3/2001 Morris et al.
D440,386 S 4/2001 James
6,213,480 B1 4/2001 Rodriguez
6,226,900 B1 5/2001 Mazars
6,233,846 B1 5/2001 Sordi
6,243,972 B1 6/2001 De France
6,247,251 B1 6/2001 James
6,247,708 B1 6/2001 Hsu
6,250,656 B1 6/2001 Ibarra
6,308,964 B1 10/2001 Chang
6,336,644 B1 1/2002 Chu
6,340,164 B1 * 1/2002 Borel ..... A43B 5/1641 280/11.221
6,343,800 B2 2/2002 Clementi
6,354,609 B1 3/2002 Chen et al.
6,357,145 B1 3/2002 James
6,386,555 B1 5/2002 Kao
6,398,395 B1 6/2002 Hyun
6,406,037 B2 6/2002 Chang
6,406,038 B2 6/2002 Adams
6,406,039 B1 6/2002 Chen
6,412,791 B1 * 7/2002 Chu ..... A43B 5/1633 280/11.19
6,450,509 B2 9/2002 Adams
6,464,236 B2 10/2002 Chang
6,467,198 B1 10/2002 James
6,474,661 B1 11/2002 Chang
6,488,289 B2 12/2002 Hsiao et al.
6,523,836 B1 2/2003 Chang et al.
6,536,785 B2 3/2003 Lee
6,565,242 B2 5/2003 Dai
6,572,120 B2 6/2003 Chang
6,581,943 B2 6/2003 Wegener
6,619,823 B2 9/2003 Dai
6,621,419 B2 9/2003 Chiu
6,629,698 B2 10/2003 Chu
6,688,613 B1 2/2004 Malloy
6,698,769 B2 3/2004 Adams et al.
6,719,304 B2 4/2004 Miller et al.
6,739,602 B2 * 5/2004 Adams ..... 280/11.19
6,746,026 B2 6/2004 Adams
6,751,891 B2 6/2004 Lombardino
6,764,082 B2 7/2004 Roderick
6,786,493 B2 9/2004 Hong
6,786,552 B2 9/2004 Thiel
6,805,363 B2 10/2004 Hernandez
6,848,201 B2 2/2005 Staffaroni et al.
6,851,817 B2 2/2005 Wong
6,874,795 B2 4/2005 Sung
6,905,127 B2 6/2005 Lester
6,913,270 B2 7/2005 Wang
6,926,289 B2 8/2005 Wang
6,959,933 B1 11/2005 Roth

(56) References Cited

U.S. PATENT DOCUMENTS

| | | | | |
|---|---|---|---|---|
| 6,979,003 | B2 | 12/2005 | Adams | |
| 7,032,330 | B2 | 4/2006 | Adams et al. | |
| 7,063,336 | B2 | 6/2006 | Adams | |
| 7,121,561 | B2 | 10/2006 | Green et al. | |
| 7,165,773 | B2 | 1/2007 | Adams | |
| 7,165,774 | B2 | 1/2007 | Adams | |
| 7,195,251 | B2 | 3/2007 | Walker | |
| 7,311,164 | B1 | 12/2007 | Kertes | |
| 7,341,261 | B2 | 3/2008 | Shing | |
| 7,407,167 | B1 * | 8/2008 | Chou | A63C 17/008 280/13 |
| D595,941 | S | 7/2009 | Byrne | |
| 7,610,972 | B2 | 11/2009 | Adams et al. | |
| D608,991 | S | 2/2010 | Lamont | |
| D609,440 | S | 2/2010 | Morris | |
| 2001/0013695 | A1 * | 8/2001 | Borel | A63C 17/18 280/607 |
| 2001/0050467 | A1 | 12/2001 | Clementi | |
| 2002/0060435 | A1 | 5/2002 | Kim | |
| 2002/0070511 | A1 | 6/2002 | Adams | |
| 2002/0105154 | A1 | 8/2002 | Henselder | |
| 2002/0109312 | A1 | 8/2002 | Zheng | |
| 2002/0121749 | A1 | 9/2002 | Lee | |
| 2002/0121750 | A1 | 9/2002 | Chu | |
| 2002/0125655 | A1 * | 9/2002 | Hsiao | A43B 13/14 280/11.19 |
| 2002/0130475 | A1 | 9/2002 | Adams | |
| 2002/0145263 | A1 | 10/2002 | Yang | |
| 2003/0027409 | A1 | 2/2003 | Ramdani et al. | |
| 2003/0038432 | A1 | 2/2003 | Chang | |
| 2003/0047363 | A1 | 3/2003 | Makuta et al. | |
| 2003/0062697 | A1 | 4/2003 | Chu | |
| 2003/0141680 | A1 | 7/2003 | Clark | |
| 2003/0178799 | A1 | 9/2003 | Chen | |
| 2004/0007835 | A1 | 1/2004 | Yang | |
| 2004/0041359 | A1 | 3/2004 | Im | |
| 2004/0046340 | A1 | 3/2004 | Chen | |
| 2004/0660011 | | 4/2004 | Chu | |
| 2004/0212160 | A1 | 10/2004 | Roderick | |
| 2004/0222601 | A1 | 11/2004 | Adams | |
| 2004/0227310 | A1 * | 11/2004 | Jeon | A63C 17/1409 280/11.217 |
| 2004/0239056 | A1 | 12/2004 | Cho et al. | |
| 2005/0029756 | A1 | 2/2005 | Lin et al. | |
| 2005/0076536 | A1 * | 4/2005 | Hatfield et al. | 36/3 B |
| 2005/0082774 | A1 | 4/2005 | Chiu | |
| 2005/0210712 | A1 * | 9/2005 | Jau, Jr. | A43B 5/14 36/131 |
| 2006/0022417 | A1 | 2/2006 | Roderick | |
| 2006/0038362 | A1 | 2/2006 | Svensson et al. | |
| 2006/0101671 | A1 * | 5/2006 | Berend | A43B 3/24 36/100 |
| 2007/0002575 | A1 | 1/2007 | Chiang | |
| 2007/0090613 | A1 | 4/2007 | Lyden | |
| 2007/0164519 | A1 | 7/2007 | Adams | |
| 2007/0252351 | A1 | 11/2007 | McNamara | |
| 2007/0256331 | A1 * | 11/2007 | Narajowski | A43B 5/04 36/117.3 |
| 2007/0296164 | A1 | 12/2007 | Roderick | |
| 2008/0093955 | A1 | 4/2008 | Lunde | |
| 2008/0289222 | A1 * | 11/2008 | Candrian et al. | 36/101 |
| 2008/0313928 | A1 | 12/2008 | Adams | |
| 2009/0033046 | A1 * | 2/2009 | Wilborn | 280/11.19 |
| 2009/0077833 | A1 | 3/2009 | Kokavec | |
| 2009/0200763 | A1 * | 8/2009 | Adams | A63C 17/20 280/11.19 |
| 2009/0293309 | A1 * | 12/2009 | Keating | A43B 5/10 36/88 |
| 2009/0293313 | A1 | 12/2009 | Bruce et al. | |
| 2010/0289230 | A1 * | 11/2010 | Duarte | A63C 17/01 280/11.204 |
| 2011/0057400 | A1 * | 3/2011 | Wills | 280/11.203 |

FOREIGN PATENT DOCUMENTS

| | | | |
|---|---|---|---|
| CA | 1138194 | | 12/1982 |
| CA | 1239017 | | 7/1988 |
| CA | 2258978 | | 7/2000 |
| CA | 2258980 | | 7/2000 |
| CH | 84073 | | 2/1920 |
| CN | 85204533 | U | 10/1986 |
| CN | 2246527 | Y | 2/1997 |
| CN | ZL98300231.2 | | 1/1998 |
| CN | ZL 97244602.8 | | 4/1999 |
| CN | 2520912 | Y | 11/2002 |
| CN | 03316715.X | | 5/2003 |
| DE | 254775 | | 5/1912 |
| DE | 309567 | A | 10/1918 |
| DE | 456796 | | 3/1928 |
| DE | 723266 | | 8/1942 |
| DE | 821323 | | 7/1949 |
| DE | 204456 | | 7/1959 |
| DE | 2321669 | | 3/1974 |
| DE | 2550211 | A1 | 5/1976 |
| DE | 2615266 | | 10/1977 |
| DE | 2821644 | A1 | 5/1978 |
| DE | 29613508 | U1 | 10/1996 |
| DE | 19755340 | A1 | 6/1999 |
| DE | 20012020 | U1 | 11/2000 |
| DE | 20014266 | U | 11/2000 |
| DE | 20023053.0 | | 10/2002 |
| EP | 0695513 | | 2/1996 |
| EP | 0933104 | | 8/1999 |
| EP | 1113846 | | 7/2001 |
| EP | 1254686 | | 11/2002 |
| EP | 1530915 | | 5/2005 |
| ES | 222715 | Y | 8/1976 |
| ES | 248126 | Y | 12/1980 |
| ES | 1047932 | U | 6/2001 |
| ES | 1048059 | U | 6/2001 |
| ES | 1048274 | U | 7/2001 |
| ES | 1048293 | U | 7/2001 |
| ES | 1048400 | U | 8/2001 |
| FR | 1194886 | A | 11/1959 |
| FR | 2196826 | | 3/1974 |
| FR | 2291715 | | 6/1976 |
| FR | 2530126 | | 1/1984 |
| FR | 2715320 | | 7/1995 |
| FR | 2718652 | | 10/1995 |
| FR | 2757412 | | 6/1998 |
| FR | 2758093 | | 7/1998 |
| FR | 2822077 | | 9/2002 |
| FR | 2828636 | | 2/2003 |
| GB | 2297 | | 6/1877 |
| GB | 117176 | | 7/1918 |
| GB | 150512 | A | 9/1920 |
| GB | 216903 | A | 1/1925 |
| GB | 1388234 | | 3/1975 |
| GB | 2363562 | | 3/2000 |
| GB | 2380685 | | 4/2003 |
| GB | 2407993 | | 5/2005 |
| IT | 666436 | | 8/1964 |
| JP | 6417 | | 8/1907 |
| JP | 17-3781 | | 3/1942 |
| JP | 368449 | | 12/1949 |
| JP | 50-139077 | | 11/1975 |
| JP | 56-1685 | | 1/1981 |
| JP | 57-145459 | | 9/1982 |
| JP | 58-30474 | | 2/1983 |
| JP | 58-142078 | | 9/1983 |
| JP | 59-55574 | | 4/1984 |
| JP | 61-94621 | | 6/1986 |
| JP | 63-135673 | | 9/1988 |
| JP | 2-82903 | | 6/1990 |
| JP | 05-18567 | | 3/1993 |
| JP | 05-021985 | | 3/1993 |
| JP | 5-40721 | | 10/1993 |
| JP | 7-79804 | | 3/1995 |
| JP | 07-185062 | | 7/1995 |
| JP | 9-508826 | | 9/1997 |
| JP | 10-15145 | | 1/1998 |
| JP | 10-234927 | | 9/1998 |

(56) References Cited

FOREIGN PATENT DOCUMENTS

| | | |
|---|---|---|
| JP | 10-509059 | 9/1998 |
| JP | 2001-252390 | 9/2001 |
| JP | 2001-314542 | 11/2001 |
| JP | 2002-248196 | 9/2002 |
| JP | 2004-16757 | 1/2004 |
| JP | 2004-97814 | 4/2004 |
| JP | 2004-236703 | 8/2004 |
| JP | 2004-305700 | 11/2004 |
| JP | 2005-144177 | 6/2005 |
| JP | 2006-21002 | 1/2006 |
| JP | 2007-21120 | 2/2007 |
| KR | 90-11303 | 3/1988 |
| KR | 2002-0065437 | 8/2002 |
| KR | 2003-0051516 | 6/2003 |
| KR | 20-0325185 | 8/2003 |
| KR | 10-0452961 | 10/2004 |
| KR | 20-0364789 | 10/2004 |
| KR | 20-0369807 | 11/2004 |
| KR | 20-0378100 | 2/2005 |
| KR | 20-0398724 | 10/2005 |
| KR | 10-0572144 | 4/2006 |
| KR | 10-0572145 | 4/2006 |
| SE | 386828 | 8/1976 |
| WO | WO 92/05845 | 4/1992 |
| WO | WO 95/20424 | 8/1995 |
| WO | WO 96/06663 | 3/1996 |
| WO | WO 96/40393 | 12/1996 |
| WO | WO 98/01051 | 1/1998 |
| WO | WO 98/03236 | 1/1998 |
| WO | WO 98/26845 | 6/1998 |
| WO | WO 99/02228 | 1/1999 |
| WO | WO 00/16862 | 3/2000 |
| WO | WO 00/59323 | 10/2000 |
| WO | WO 01/91863 | 12/2001 |
| WO | WO 02/11831 A1 | 2/2002 |
| WO | WO 02/13927 | 2/2002 |
| WO | WO 02/17474 | 2/2002 |
| WO | WO 02/41958 | 5/2002 |
| WO | WO 03/024264 | 3/2003 |
| WO | WO 03/041526 | 5/2003 |
| WO | WO 03/059475 | 7/2003 |
| WO | WO 03/072205 | 9/2003 |
| WO | WO 2004/011110 | 2/2004 |
| WO | WO 2004/058365 | 7/2004 |
| WO | WO 2009/025798 | 2/2009 |

* cited by examiner

HEELING APPARATUS

PRIORITY

This application is a non-provisional of and claims priority to U.S. Provisional Application No. 61/679,445, filed on Aug. 3, 2012, entitled Heeling Apparatus, the entire contents of which are hereby incorporated by reference.

BACKGROUND

As the sport and transportation mechanism of "heeling" has evolved, a need has arisen for new and innovative footwear configured to accommodate a wheel assembly and mounting structure.

SUMMARY

The present disclosure is directed to a heeling apparatus including an inner shell and an outer shell. The outer shell is configured to interlock with the inner shell.

In one embodiment, the inner shell includes a plurality of protrusions configured to interlock with receiving apertures in the outer shell. The protrusions include one or more protrusions around the heel of the heeling apparatus. In various embodiments, the inner shell also includes one more protrusions on its sole, which are configured to interlock with receiving apertures on the sole of the outer shell.

In various embodiments, the outer shell and the inner shell are configured to be interchangeable.

In one embodiment, the inner shell includes a cavity configured to receive a bracket. The bracket includes a mounting assembly configured to receive a wheel assembly. The bracket is held in place by the interlocked relationship of the inner shell and the outer shell. Holding the bracket in place in this manner makes assembly and disassembly easier relative to prior designs, lowers the cost of manufacture and eliminates the need for tools for assembling and disassembling the heeling apparatus.

Additionally, the present disclosure provides a bracket which is designed with carve-outs, which minimize weight, and has a surface geometry which distributes weight in a manner which improves user comfort. The bracket includes vertical ribs that follow the slope of the insole, thereby dispersing heel pressure and improving user comfort while skating or "heeling."

In another embodiment, the cavity in the inner shell is configured to receive a plug that engages with an opening in the sole of the outer shell.

In various embodiments, the heeling apparatus includes a brake pad including extensions which are configured to extend through receiving apertures in the bottom of the outer shell.

The heeling apparatus is configured for three primary modes of operation. In a first mode of operation, referred to as a shoe configuration, the heeling apparatus comprises the inner shell and the outer shell, with the plug being housed in the cavity of the inner shell, instead of the bracket.

In a second mode of operation, referred to as a skate configuration, the heeling apparatus comprises the inner shell and the outer shell, with the bracket being housed in the cavity of the inner shell, and the bracket further having the wheel assembly mounted therein.

In a third mode of operation, referred to as a hybrid configuration, the heeling apparatus comprises the inner shell and the outer shell, with the cavity of the inner shell housing just the bracket with the option of mounting the wheel assembly.

Additional features and advantages are described herein, and will be apparent from the following Detailed Description and the figures.

DETAILED DESCRIPTION

Figure 1:
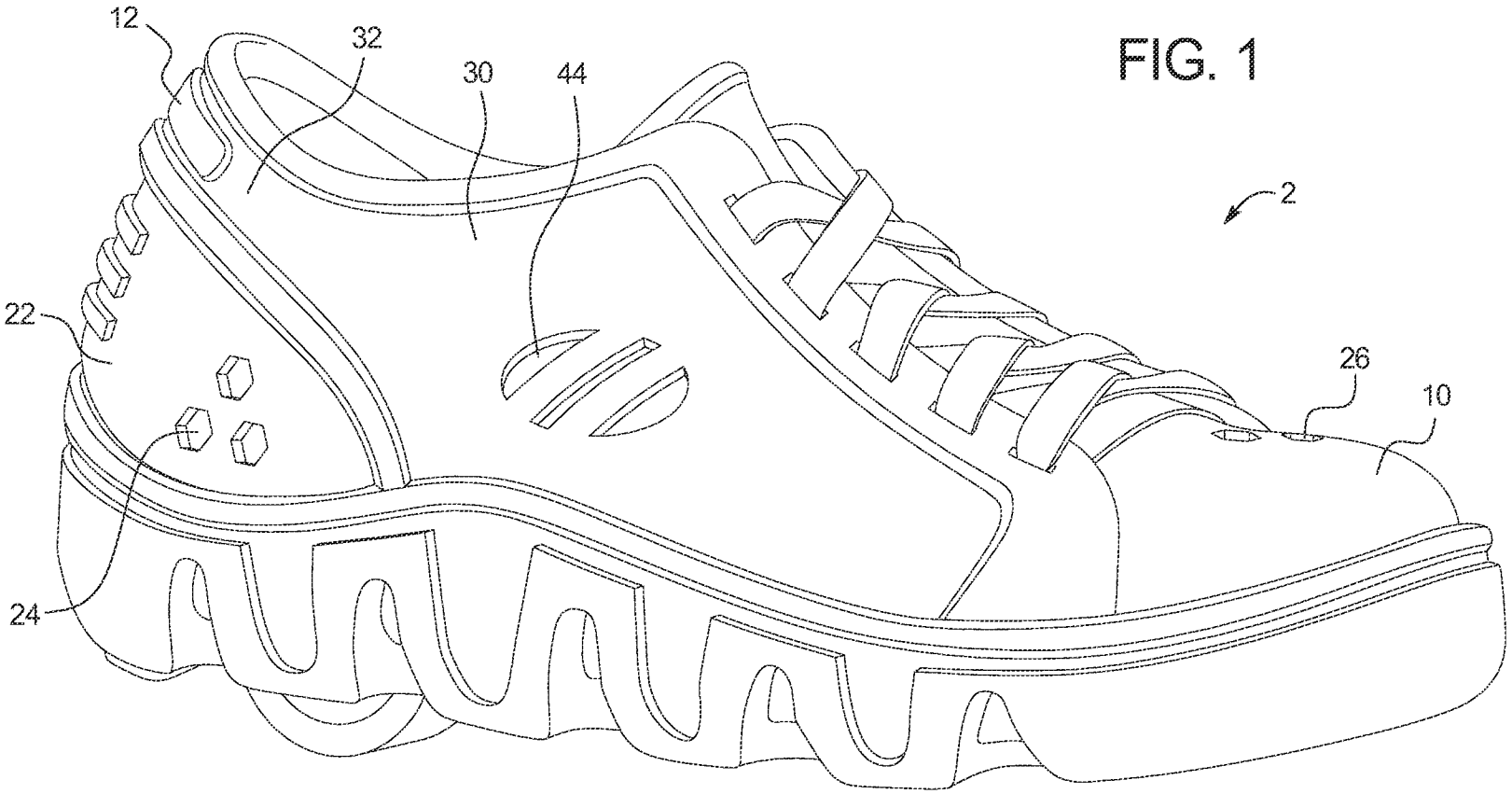
FIG. 1 is a perspective view of the heeling apparatus.

Referring now to FIG. 1, the present disclosure is directed to a heeling apparatus 2 including an inner shell 10 and an outer shell 30. The outer shell 30 is configured to interlock with the inner shell 10.

In one embodiment, the inner shell 10 includes a plurality of protrusions or tabs configured to interlock with receiving apertures or openings in the outer shell 30. The protrusions or tabs include one or more protrusions around the heel of the heeling apparatus. In various embodiments, the inner shell 10 also includes one more protrusions on its sole or bottom, which are configured to interlock with receiving apertures or openings on the sole of the outer shell 30.

Figure 2:
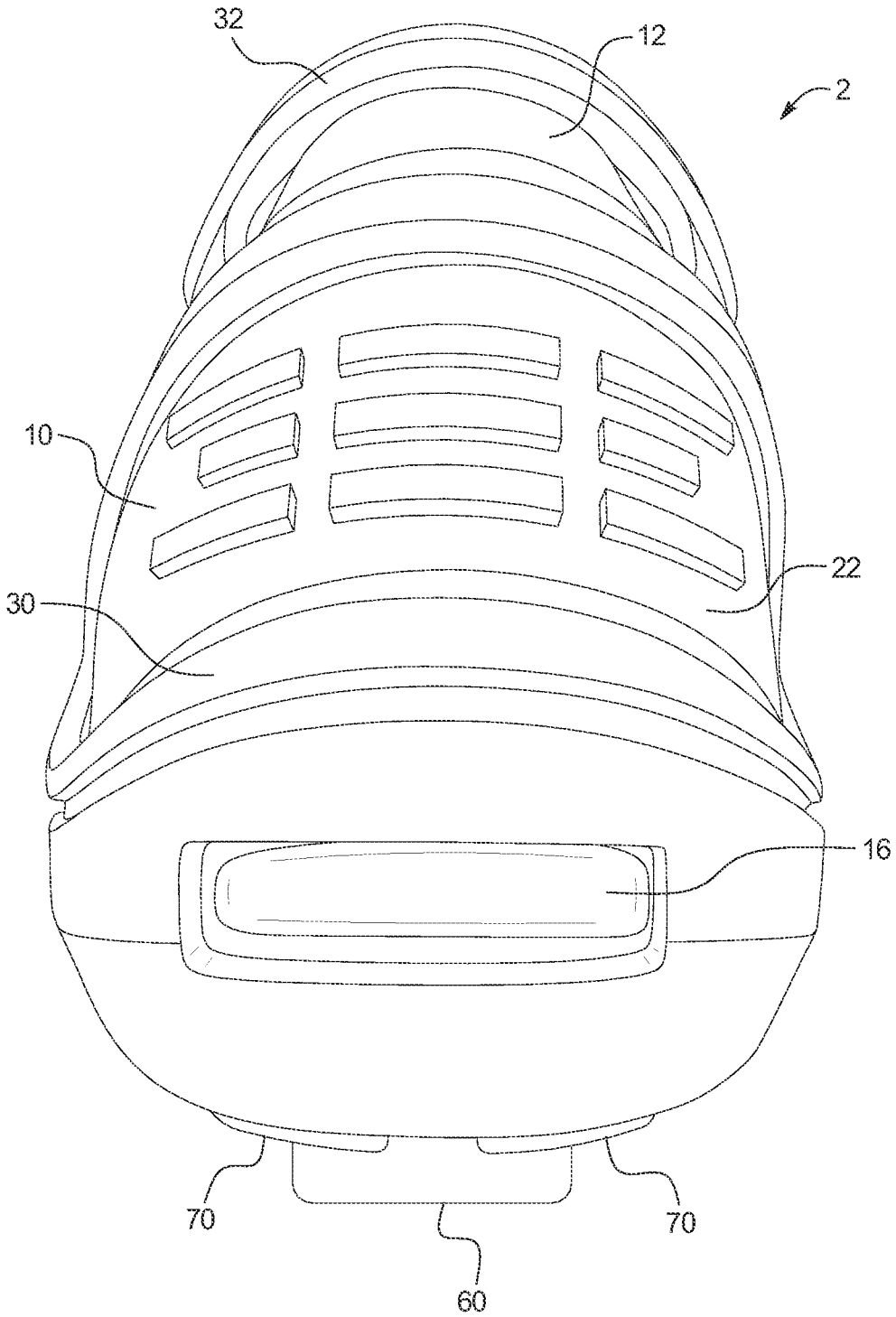
FIG. 2 is a rear view of the heeling apparatus.

Referring still to FIG. 1 and to FIG. 2, in one specific embodiment, the inner shell includes a tab 16 located at the heel area of the heeling apparatus 2 and a tab 12 around the area of the upper heel (or Achilles area of the user) (also referred to as the "Achilles tab"). These tabs are configured to engage with corresponding apertures in the outer shell 30. The inner shell 10 also includes a plurality of protrusions around the front of the sole of the inner shell 10. These protrusions are configured to engage with openings in the outer shell 30 of the heeling apparatus 2. It should be appreciated that in various embodiments, the inner shell 10 includes any number of protrusions or tabs in any shape or configuration and the outer shell includes any number of corresponding apertures or openings in any shape or configuration.

Referring still to FIG. 1 and FIG. 2, the outer shell 30 includes a heel strap 32. In this embodiment, the opening engaging with tab 12 of the inner shell 10 is defined by the heel strap 32.

FIG. 1 and FIG. 2 also illustrate a heel counter locking mechanism 22 that is a protrusion extending outward from inner shell 10. Reference characters 24, 26 and 44 of FIG. 1 illustrate ventilation openings provided at various points on both of the inner shell 10 and outer shell 30. In this embodiment, heel ventilation 24 and vamp ventilation 26 are provided in inner shell 10 and quarter ventilation 44 is provided in outer shell 30. It should be appreciated that in various embodiments, ventilation openings are provided in any shape and number and at any position on the inner shell 10 and/or outer shell 30.

FIG. 2 provides a rear view of the heeling apparatus 2, also illustrating tab 16 and Achilles tab 12. Referring still to FIG. 2, in various embodiments, the heeling apparatus includes a brake pad 70, discussed in more detail below, including protrusions which are configured to extend through brake pad openings in the sole of the outer shell.

Figure 3:
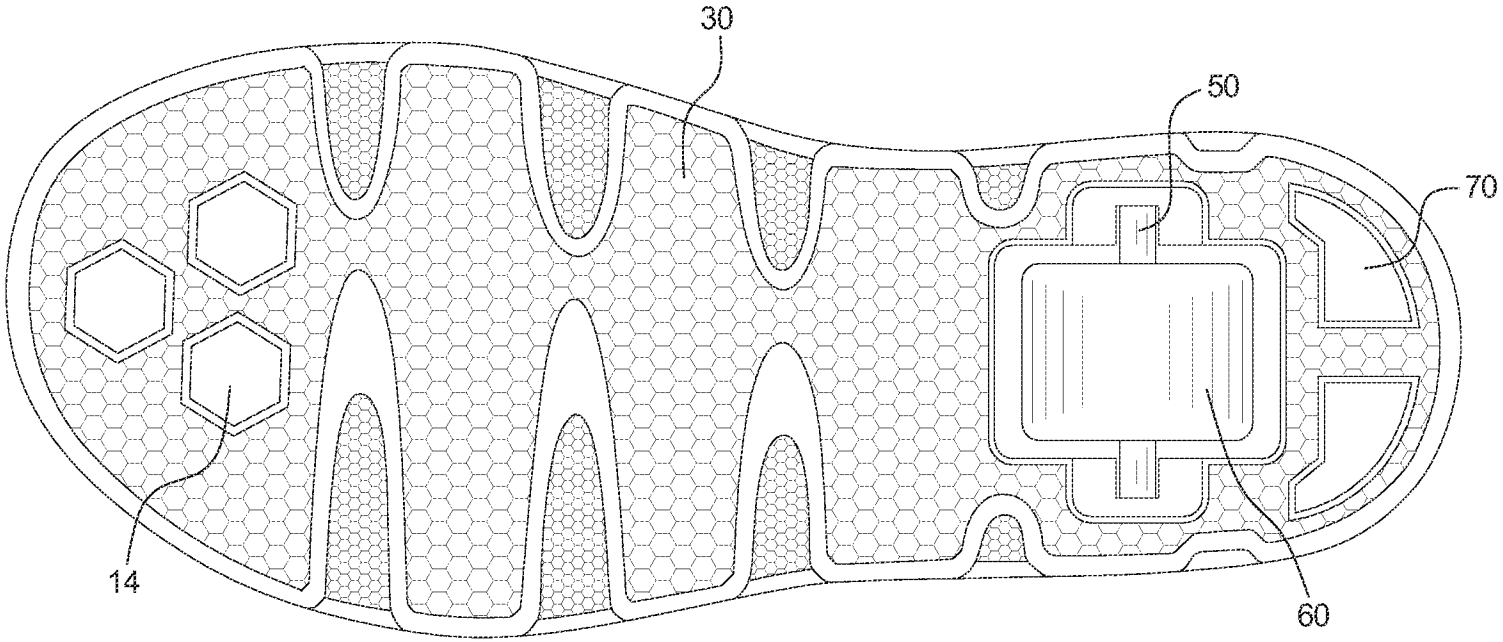
FIG. 3 is a bottom view of the heeling apparatus.

FIG. 3 provides a bottom view of the heeling apparatus. Referring to FIG. 3, in one embodiment, the inner shell 10 includes three forefront locks 14. In this specific embodiment, the forefront locks or protrusions 14 are in the shape of a hexagon. In this embodiment, the use of a hexagon provides more surface areas for the protrusions to cover the corresponding seat in the inner shell 10 when the protrusions 14 are in a locked position with the outer shell 30. In various embodiments, the forefront locks are any suitable shape and provided in any suitable number. FIG. 3 also provides an illustration of bracket 50, discussed in more detail below, and wheel 60.

It should be appreciated that the interlocking between the inner shell 10 and the outer shell 30 minimizes movement of the inner shell 10 and outer shell 30 relative to one another. This maximizes the stability, safety and performance of the heeling apparatus 2 when a user is using it in both a configuration with and without the wheel assembly.

In various embodiments, the outer shell 30 and the inner shell 10 are configured to be interchangeable. For example, a user may wish to use various color combinations of the inner shell 10 and the outer shell 30. Also, a user may wish to have the inner shell 10 and outer shell 30 be comprised of different materials.

Figure 4:
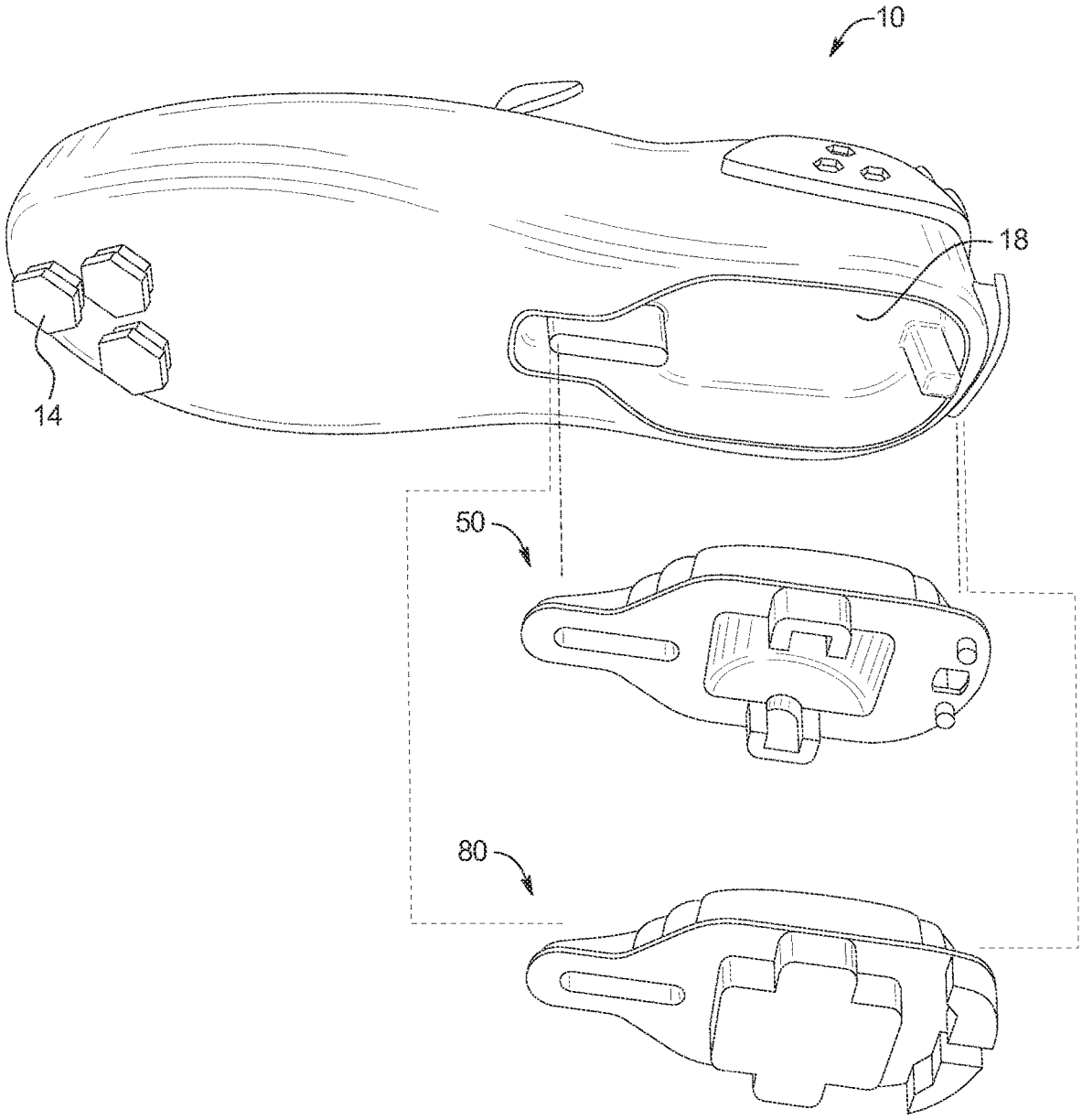
FIG. 4 is a perspective exploded view of the plug or the wheel bracket relative to the inner shell.

FIG. 4 provides an exploded view of inner shell 10 and various components configured to engage with inner shell 10. Referring to FIG. 4, the inner shell includes a cavity 18 which is configured to receive either a bracket 50 or a plug 80. The inner shell cavity includes one or more male connectors which are configured to engage with either of the bracket 50 or the plug 80. It should be appreciated that in various embodiments, the male connectors are configured to engage with other suitable attachments or fillers. Additionally, in various other embodiments, the cavity includes female connector portions, or no such connectors.

Figure 5:
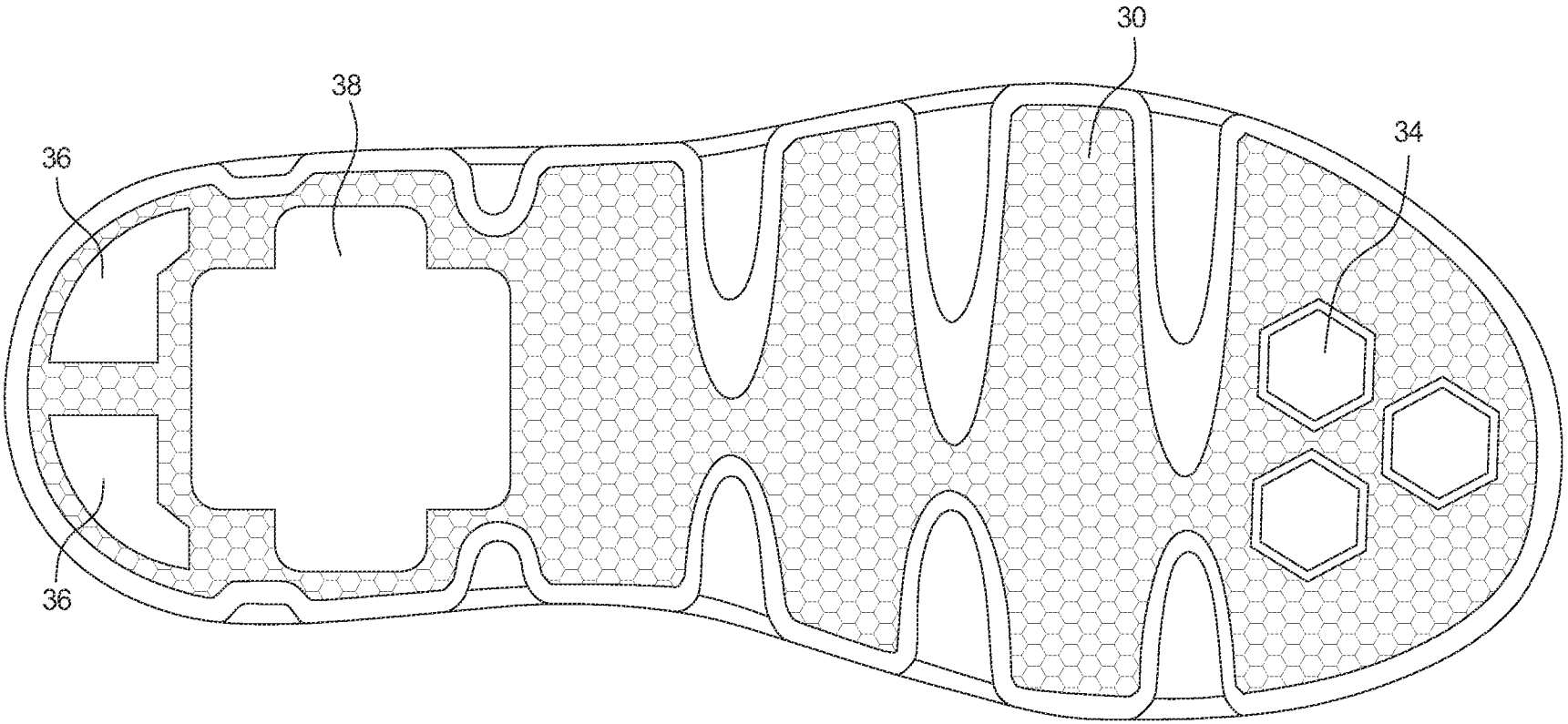
FIG. 5 is a bottom view of the outer shell.

FIG. 5 illustrates a bottom view of the outer shell 30. This illustration shows brake pad openings 36 which are configured to receive brake pad extensions 74. Also illustrated in this embodiment are the forefront receivers 34 and wheel opening 38. The forefront receivers 34 are configured to receive forefront locks 14 and the wheel opening 38 corresponds to the position of the bracket 50 in the inner shell 10 and is configured to enable the wheel 60 or a plug 80 to extend through it. It should be appreciated that in various embodiments, the bottom of the outer shell 30 includes any suitable number of openings, in any shape and at any suitable number of positions.

Figure 6:
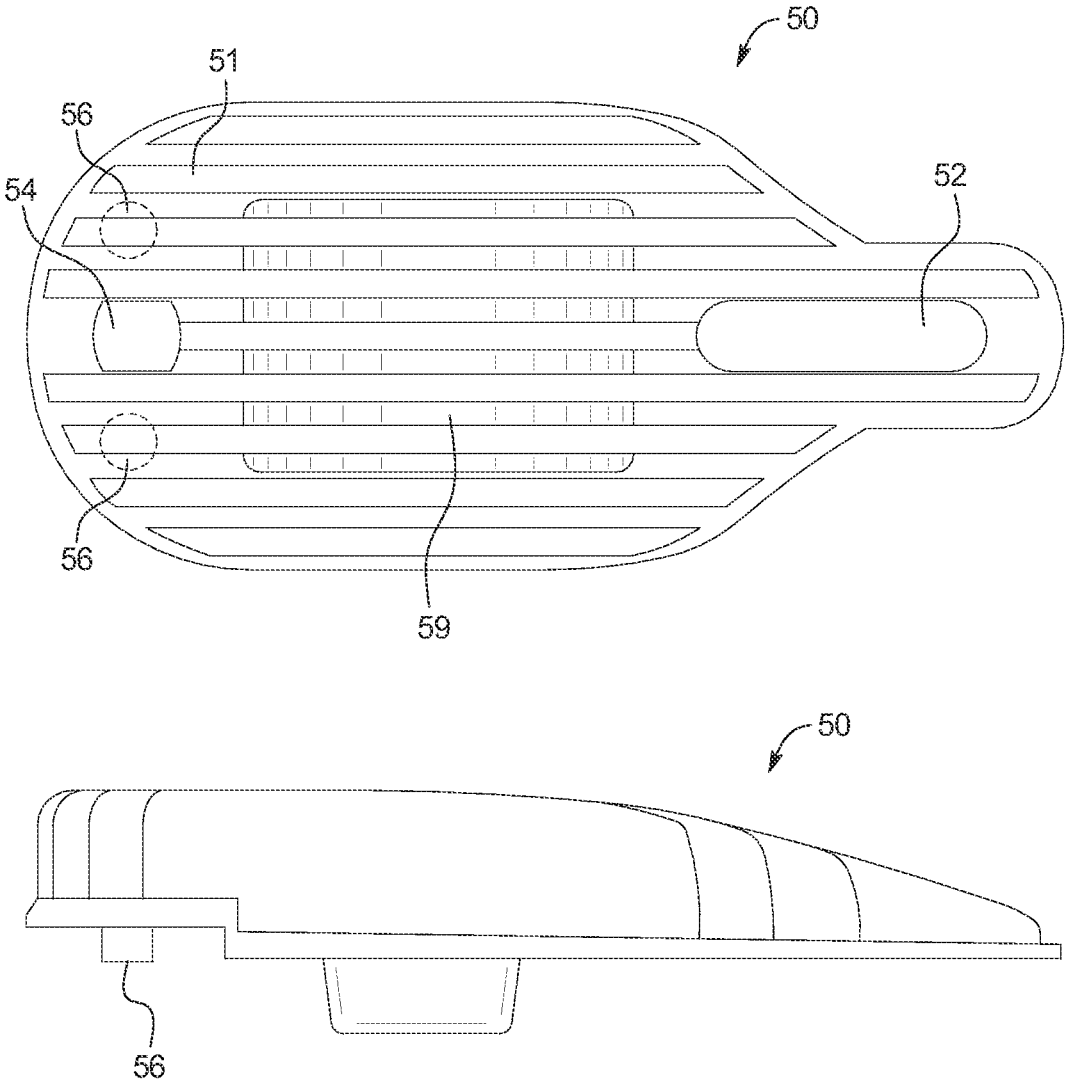
FIG. 6 is a top view and side view of the bracket.

FIG. 6 provides a further illustration of the bracket 50. Bracket 50 includes front female portion 52 and rear female portion 54 which are configured to receive male protrusions extending from cavity 18 of the inner shell 10. The combination of these male and female connector portions makes for a more stable connection between the inner shell 10 and the bracket 50, minimizing yaw and providing for a safer and more comfortable heeling or skating experience. It should be appreciated that in various embodiments, the bracket 50 engages with inner shell 18 in any suitable manner. It should further be appreciated that in various embodiments, no male or female connectors are used in connecting the bracket 50 to the cavity 18. It should also be appreciated that in embodiments with connectors, various numbers of connectors in various shapes are used.

FIG. 6 further illustrates vertical ribs 59 in the bracket which follow the slope of the insole and disperse heel pressure and improve comfort for a user while they are "heeling" or skating.

Figure 7:
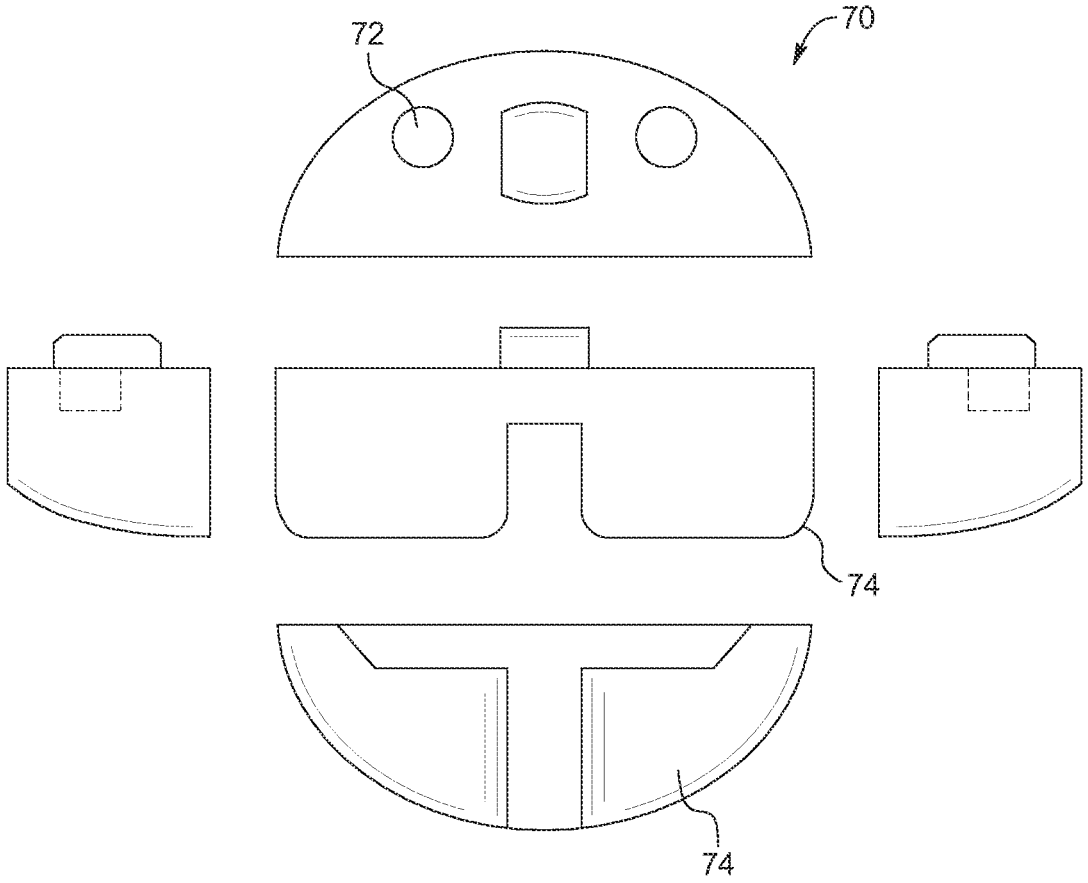
FIG. 7 is a top, bottom, back and side view of a brake pad configured for use with the heeling apparatus.

FIG. 7 provides an illustration of a brake pad 70 configured for use with the heeling apparatus. Brake pad 70 includes extensions 74 which extend from the body of the brake pad 70 and are configured to engage with the ground to enable a user to slow down or stop. In various embodiments the brake pad 70 is made of a hard or high-abrasion rubber or similar material. It should be appreciated that in various embodiments, the brake pad 70 is composed of a different material than the inner shell 10 and/or outer shell 30. In one embodiment, the brake pad 70 includes indentions 72 as illustrated in FIG. 7 which are configured to engage with brake pad connectors 56 extending from the bottom of the bracket 50.

Figure 8:
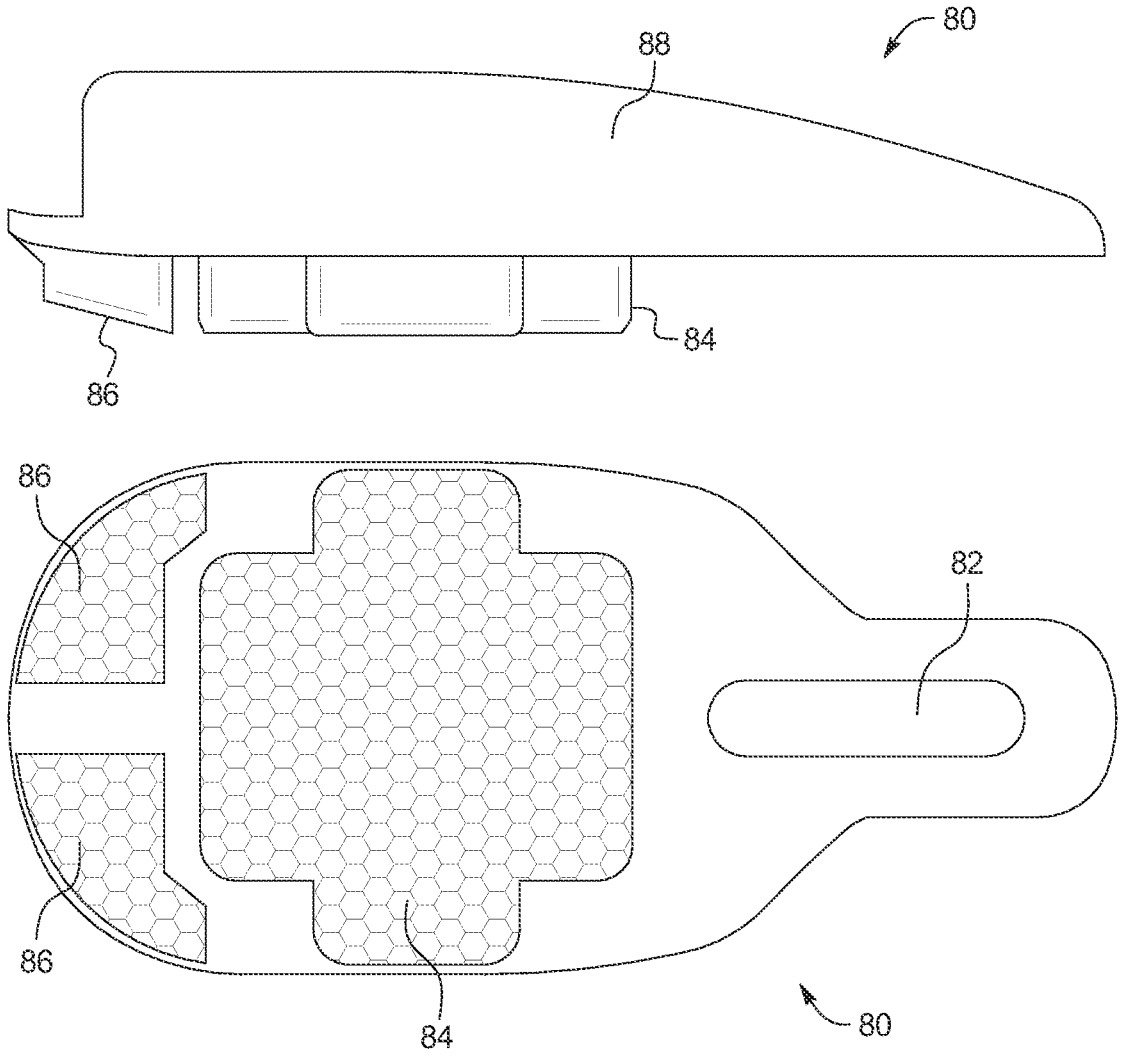
FIG. 8 is a bottom and side view of a plug configured to engage with the outer shell.

Referring now to FIG. 8, a bottom and side view of the plug 80 is illustrated. Plug 80 is configured to be received into cavity 18 of the inner shell 10 in a scenario where a user wants to use the heeling apparatus 2 as a shoe. In this embodiment, the plug 80 includes a front female portion 82 that is configured to engage the front male protrusion of cavity 18. It should also be appreciated that in other embodiments, the plug 80 is configured to include addition female portions or male connectors as suitable to engage with cavity 18. In this embodiment, the plug 80 includes an extension 84 which corresponds in shape and is configured to extend through wheel opening 38 in the outer shell 30. It should be appreciated that in various embodiments, the extension 84 is any suitable shape, as is the wheel opening 38. In this embodiment, the plug 80 also includes brake extensions 86 which are configured to protrude through brake pad openings 36 in the outer shell 30. It should be appreciated that in various embodiments, the brake extensions 86 and the corresponding openings 36 are any suitable shape or material. In various embodiments, the plug body 88 and its extensions 84 and 86 are the same or different materials. In one embodiment, the extensions 84 and 86 are a hard rubber material. In other embodiments, the extensions 84 and 86 are the same material as the outsole or bottom of the outer shell 30. In various other embodiments, the extensions 84 and 86 have the same texture, such as a hexagon pattern, as that of the bottom or outsole of the outer shell 30. In various embodiments, the plug 80 includes a gel-type insert or insert of a different material than the rest of the plug 80 that enhances user comfort.

Figure 9:
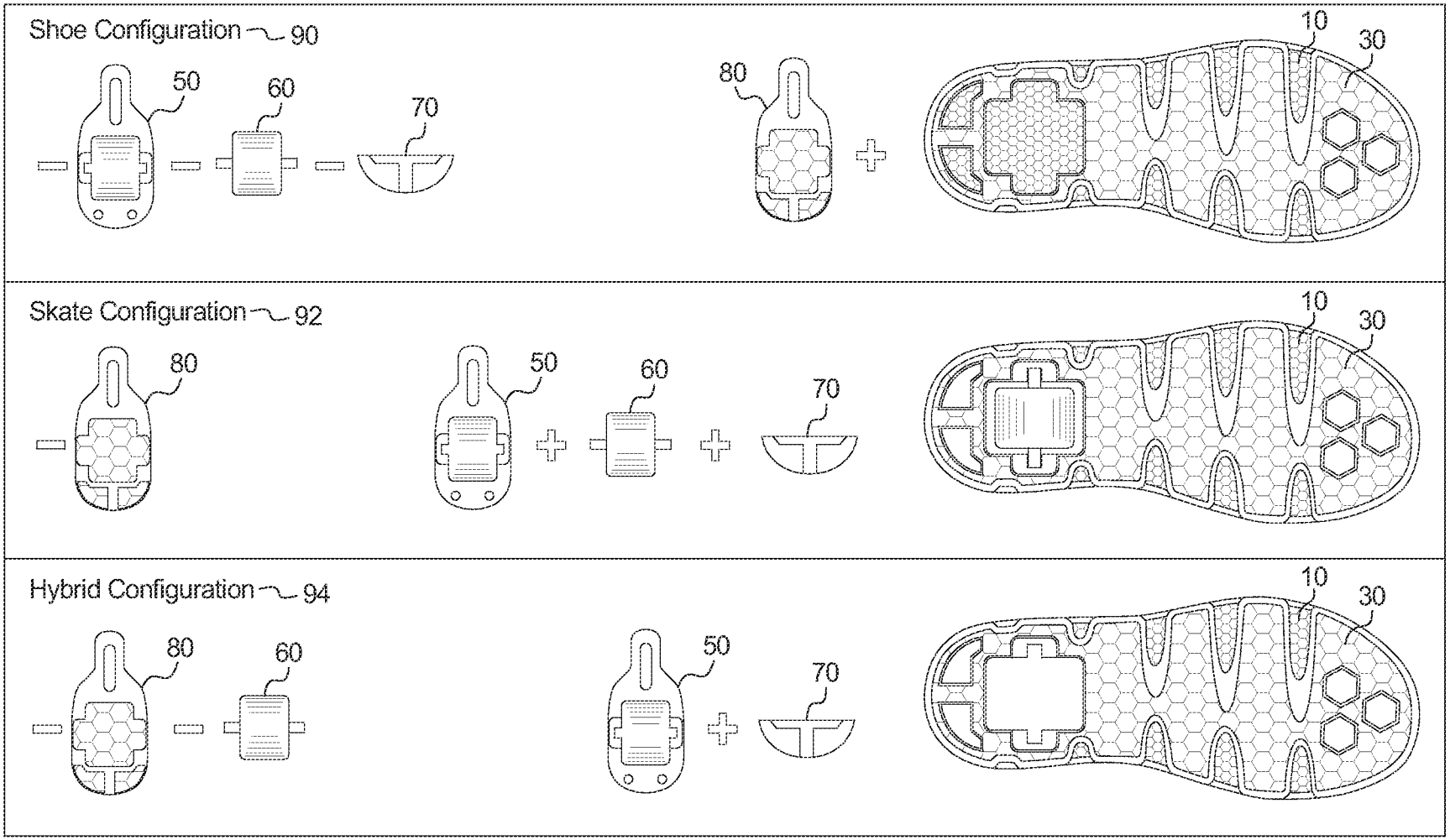
FIG. 9 illustrates three modes of operation of the heeling apparatus and the component parts associated therewith.

As illustrated in FIG. 9, the heeling apparatus is configured for three primary modes of operation. In a first mode of operation, referred to as a shoe configuration 90, the heeling apparatus comprises the inner shell 10 and the outer shell 30, with the plug 80 being housed in the cavity 18 of the inner shell 10, instead of the bracket 50. In this configuration, the brake pad 70 is removed, with the brake extensions 86 of the plug 80 extending through the outer shell 30.

In a second mode of operation, referred to as a skate configuration 92, the heeling apparatus comprises the inner shell 10 and the outer shell 30, with the bracket 50 being housed in the cavity 18 of the inner shell 10, and the bracket 50 further having the wheel assembly 50 mounted therein. In this configuration, the brake pad 70 is mounted between the inner shell 10 and the outer shell 30.

In a third mode of operation, referred to as a hybrid configuration 94, the heeling apparatus comprises the inner shell 10 and the outer shell 30, with the cavity 18 of the inner shell 10 housing the bracket 50, leaving the option of mounting the wheel assembly. It should be appreciated that in this configuration, the brake pad 70 is mounted between the inner shell 10 and the outer shell 30.

Figure 10:
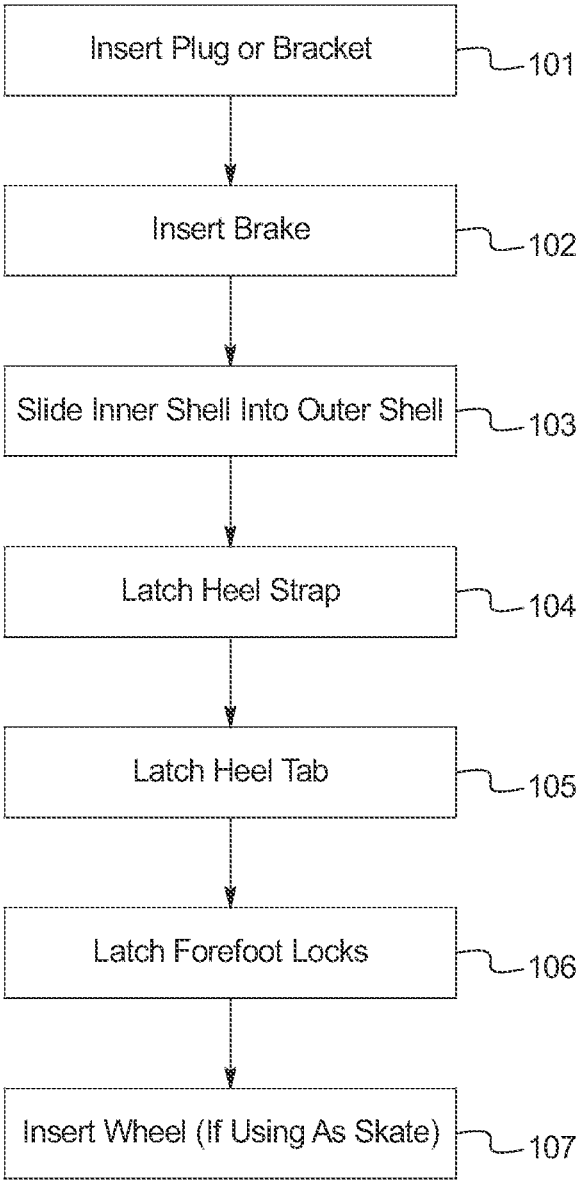
FIG. 10 illustrates a method of assembling the heeling apparatus.

FIG. 10 illustrates a method of assembling the heeling apparatus 2. Referring to step 101, beginning with just the inner shell 10, if a user wishes to use the heeling apparatus 2 as a shoe, the user inserts plug 80 into cavity 18 of the inner shell 10. If the user wishes to use the heeling apparatus 2 to skate the user inserts the bracket 50 into cavity 18 of the inner shell 10 instead of the plug 80.

Referring to step 102 in FIG. 10, the user then inserts the brake pad 70 into the brake cavity 40 defined by the outer shell. It should be appreciated that in certain embodiments, discussed in more detail below, in which the bottom of the bracket 50 engages the brake pad 70, the brake pad needs to be inserted in the brake pad cavity 40 of the outer shell 30 prior to sliding the inner shell 10 having bracket 50 in the cavity 18 into the outer shell 30 as outlined below.

Referring to step 103 in FIG. 10, the user then slides the inner shell 10 toe-first into the outer shell 30 between the heel strap 32 and the outsole. It should be appreciated that one of the advantages of the present disclosure is the ability to insert and remove the inner shell 10 without having to remove the laces (if applicable) of the outer shell 30.

Referring to step 104 in FIG. 10, the user then uses their thumbs to lift the heel strap 32 over the inner shell Achilles locking tab 12, making sure that the tab 12 is fully seated in the outer shell heel strap groove.

Referring to step 105 in FIG. 10, the user then pushes down on the inside of the heel with their thumbs while using their fingers to fully seat the heel locking tab 16.

Referring to step 106 in FIG. 10, the user then pushes on the toe with both thumbs while pulling up on the bottom of the forefoot to fix the forefoot locks 14 in place, making sure that the hexagons of the forefoot locks 14 (or whatever applicable shape in other embodiments) are fully seated in their respective slots.

Referring to step 107 in FIG. 10, if the user is using the heeling apparatus 2 to skate, the user then mounts the wheel 60 into the wheel mounting apparatus 58 of the bracket 50. It should be appreciated that the wheel assembly and friction mounting apparatus operatively connected to the bracket 50 in the present disclosure are substantially as that described in U.S. application Ser. No. 09/540,125, now U.S. Pat. No. 6,450,509, directed to a Heeling Apparatus and Method, the contents of which are hereby incorporated by reference in their entirety.

Figure 11:
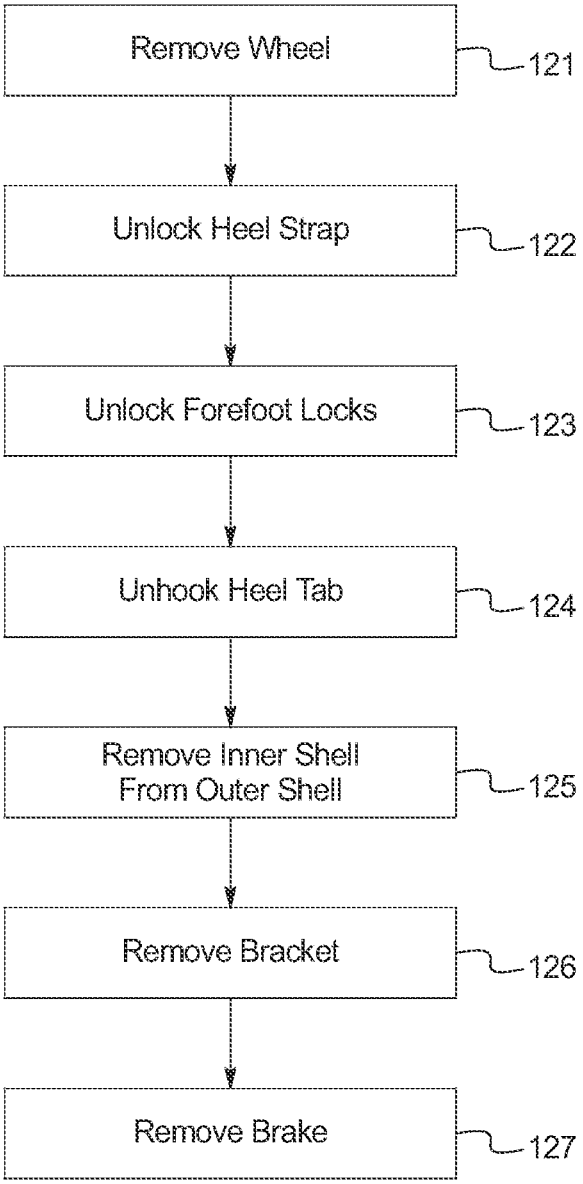
FIG. 11 illustrates a method of disassembling the heeling apparatus.

FIG. 11 provides a method of disassembling the heeling apparatus 2. Referring to step 121, a user first removes the wheel 60 by gripping the heel and using their thumbs to apply pressure to one side of the wheel until the axle pops out. This is repeated as to the other side of the wheel 60 until the wheel 60 is removed completely. It should be appreciated that in various embodiments, a user can perform the disassembly without removing the wheel 60. Not removing the wheel offers, among others, the benefit of fewer loose parts for storage and transportation. In such embodiments, the rear of the outer shell 30 is configured such that the inner shell 10 having a bracket 50 with the wheel assembly 60 engaged will slide out of the rear of the inner shell 10.

Referring now to step 122 in FIG. 11, the user unlocks the heel strap 32 by inserting their thumb between the outer shell 30 and inner shell 10 where the two pieces interlock and pulls upward on the heel strap 32 with their thumb to slide it over the Achilles locking tab 12.

Referring now to step 123 in FIG. 11, the user unlocks the forefront locks 14 by turning the heeling apparatus 2 over and popping out the forefoot locks 14 by pushing them inward with their thumbs until they disengage the outsole.

Referring to step 124 in FIG. 11, the user unlocks the heel tab 16 by gripping the sidewall of the outer shell 30 with their fingers while pushing inward on the bracket 50 with their thumbs to pop the heel tab 16 out.

Referring to step 125 in FIG. 11, the user then removes the inner shell 10 by sliding it out the back of the outer shell 30 between the heel strap 32 and the outsole. Again, the user notably does not need to remove laces of the outer shell 30 (if an embodiment with laces). It should be appreciated that in various other embodiments, the heeling apparatus 2 does not have laces.

Referring to step 126 in FIG. 11, the user then removes the bracket 50 from the cavity 18 in the inner shell 10.

Finally, referring to step 127 of FIG. 11, the user removes the brake pad 70 by using their thumbs to push the brake pad 70 inward relative to the outsole of the outer shell 30.

Figure 12:
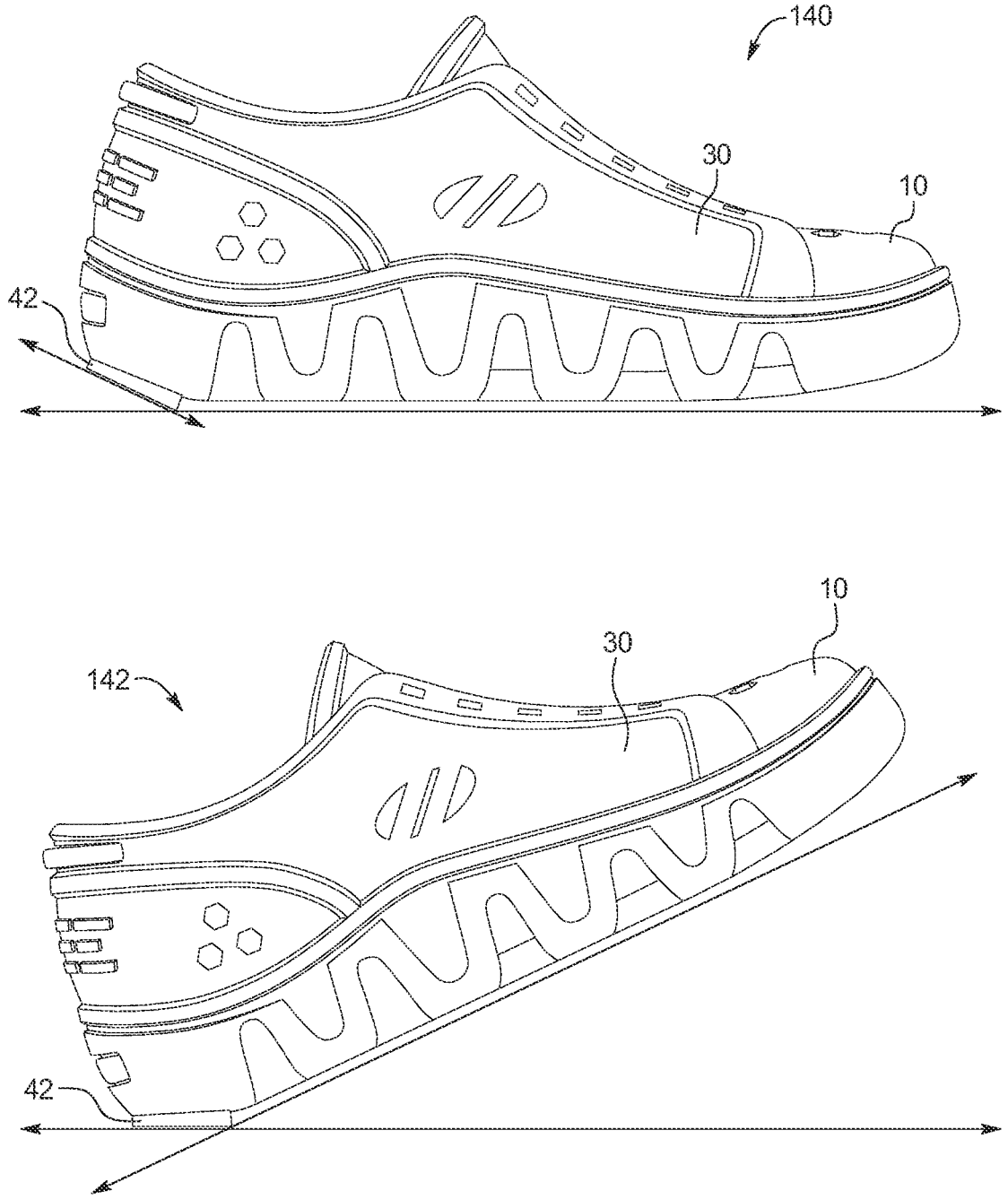
FIG. 12 illustrates an embodiment of the heeling apparatus including a heeling brake and two modes of operation associated therewith.

In various embodiments of the heeling apparatus 2, the sole of the outer shell 30 has a pronounced "heel kick" (upward angle of the rear most portion of the heel) as illustrated in FIG. 12 at the angled area 42 of the outer shell 30. This "heel kick" optimizes the amount of brake surface area that will make contact with the skating surface when the user's foot is raised to engage braking. In this embodiment, the heeling apparatus 2 includes a first position 140 in which the user is heeling or walking and the "brake" created by the angled area 42 of the outer shell 30 is not applied. The heeling apparatus 2 includes a second position 142 in which the angled area 42 or "brake" defined by the heel is in contact with the heeling surface.

In such embodiments, the brake pad 70 is also designed to have multiple possible heights (i.e., the length of brake pad extensions 74 that protrude below the outer shell 30 through brake pad openings 36). Additionally, in various embodiments, the surface area of brake pad extensions 74 which contact a skate surface is varied. A thinner brake may be more ideal for users frequently using the heeling apparatus 2 in the hybrid configuration (the bracket 50 and brake pad 70 left in, with the wheel 60 removed). It should be appreciated that various size brake pads 70 (in terms of height and/or brake surface area) may be used in embodiments of the heeling apparatus 2 both with and without the "heel kick" illustrated in FIG. 14.

Figure 13:
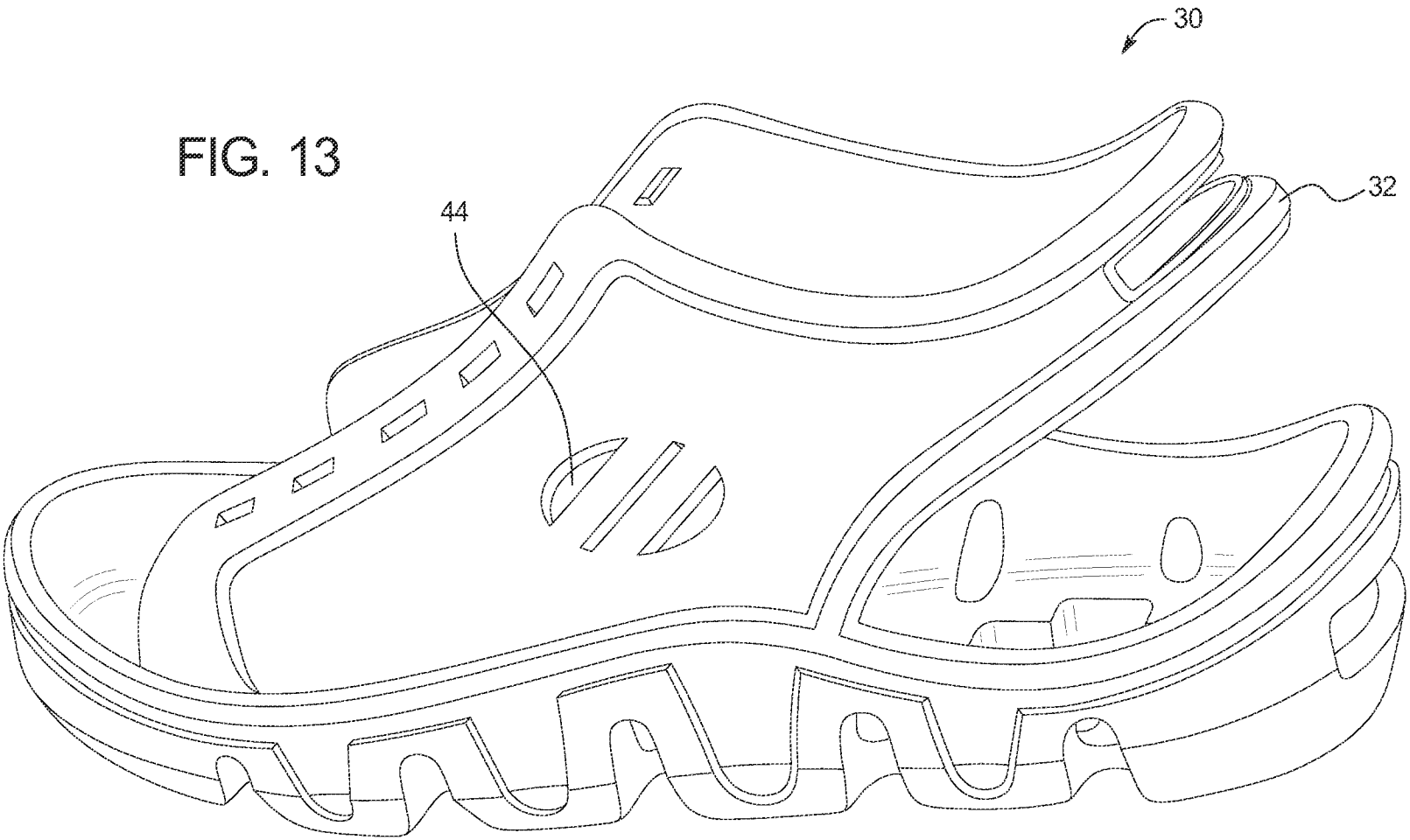
FIG. 13 is a perspective view of the outer shell.

FIG. 13 provides a perspective view of the outer shell 30 alone. It should be appreciated that in various embodiments, a user wears the outer shell 30 independently as its own piece of footwear. In one embodiment, the outer shell 30 has laces. In various other embodiments, the outer shell 30 includes a different suitable closing or tightening mechanism, such as an elastic material used in a loafer-like configuration. In various embodiments in which the outer shell 30 is worn independently, the outer shell 30 includes an attachment having a protrusion similar to that of plug 80 that extends through wheel opening 38, such that the user's heel is not touching the bare ground.

Figure 14:
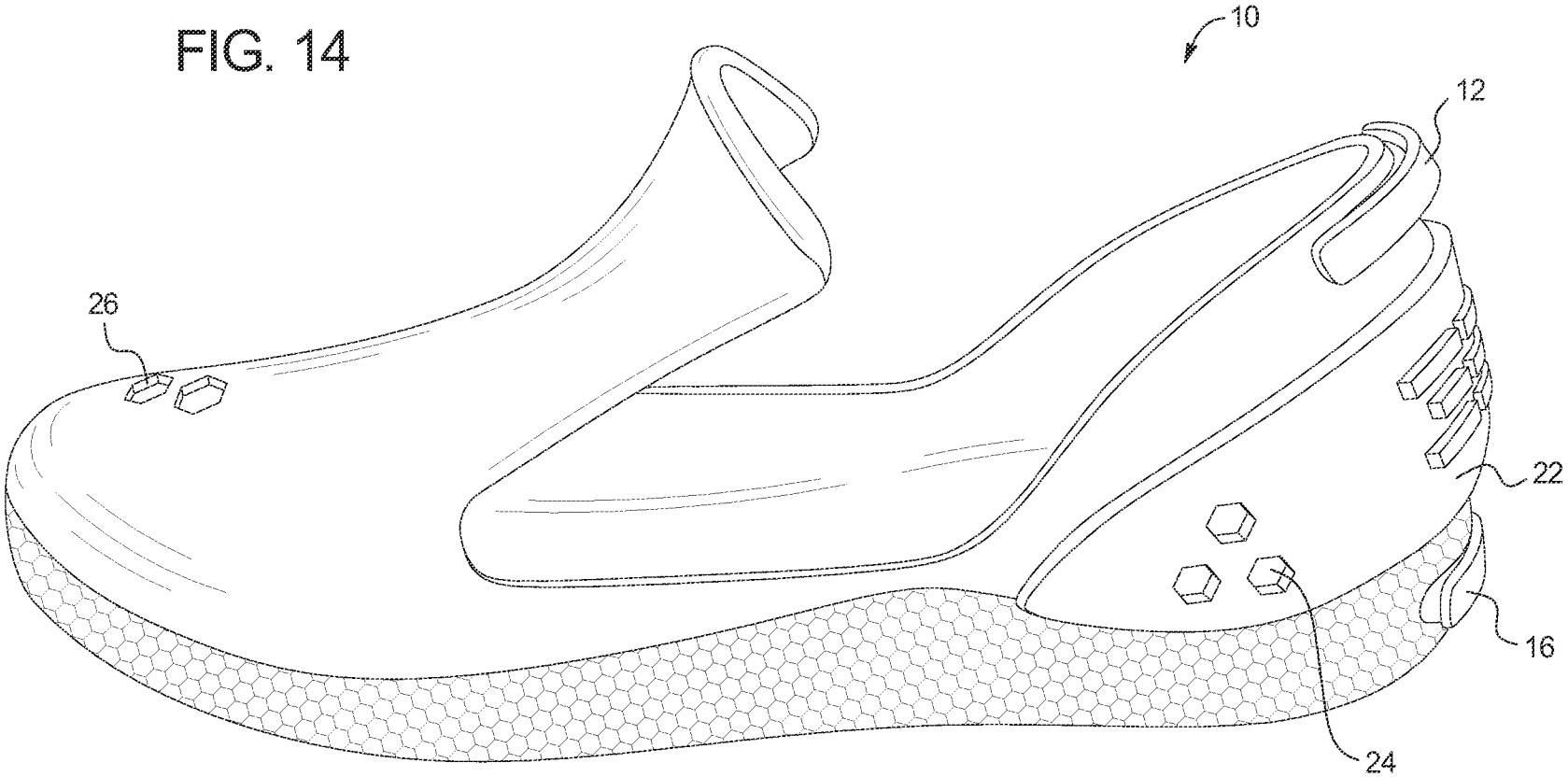
FIG. 14 is a perspective view of the inner shell.

FIG. 14 provides a perspective view of the inner shell 10 alone. It should be appreciated that in various embodiments, a user wears the inner shell 10 independently as its own piece of footwear. In such embodiments, the inner shell 10 includes a plug that mounts into the cavity 18, but does not need held in place by an outer shell. Rather, such a plug would be held in place by other suitable means (i.e., a piece wrapping around the top of the inner shell).

Figure 15:
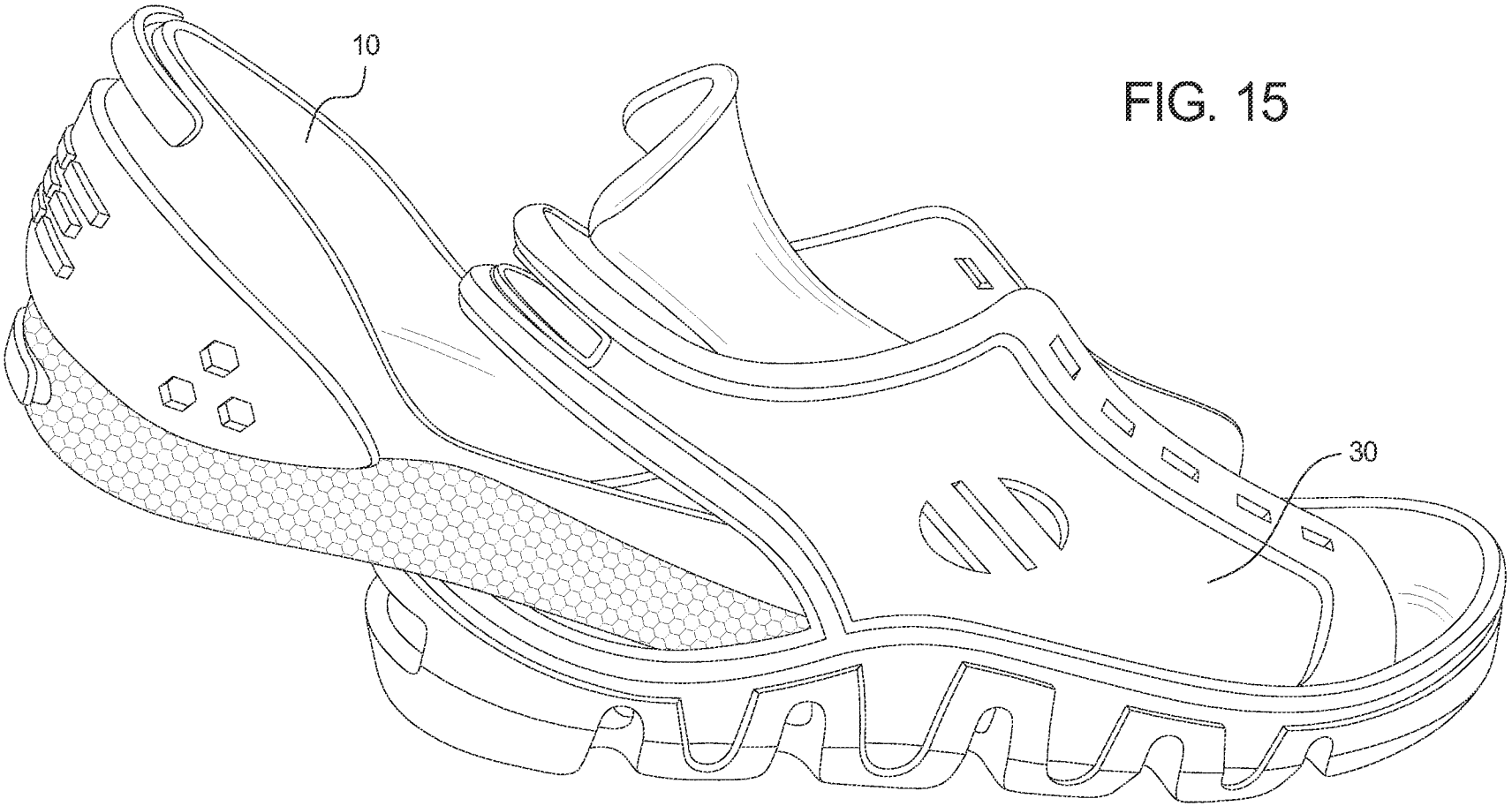
FIG. 15 is a perspective view of the inner shell in relation to the outer shell as it is inserted/removed relative to the outer shell.

FIG. 15 provides an illustration of the movement of the inner shell 10 into or out of the outer shell 30. As indicated regarding the methods illustrated in FIGS. 10 and 11, the user slides the inner shell 10 toe-first into the outer shell 30 between the heel strap 32 and the outsole and removes the inner shell 10 by sliding it out the back of the outer shell 30 between the heel strap 32 and the outsole.

It should be appreciated that in one embodiment, each of the inner shell 10 and the outer shell 30 are injection molded using ethylene vinyl acetate ("EVA"). EVA was chosen for the heeling apparatus 2, among other reasons, for its comfort, anti-microbial properties, force absorption properties and light weight. It should be appreciated that in various embodiments, the inner shell 10 and outer shell 30 are the same material or different materials and have the same texture or different textures. It should also be appreciated that in various embodiments, different surfaces (i.e., inner or outer) of the inner shell 10 and outer shell 30 have different textures. In one embodiment, certain surfaces, such as the bottom of the inner shell 10 and the outer shell 30, have a honeycomb-like texture.

In one embodiment, the plug 80 is also EVA. It should be appreciated that in various other embodiments, the plug 80 is any suitable material.

It should be appreciated that in various embodiments, the bracket 50 of the heeling apparatus 2 is configured to engage with a platform such as that described in U.S. application Ser. No. 12/878,805, directed to a Wheeled Platform Apparatus and Method for Use with Wheeled Footwear, the contents of which are hereby incorporated by reference in their entirety. In various other embodiments, the cavity 18 of inner shell 10 is configured to receive a different type of bracket which is constructed to engage with such a platform.

It should be appreciated that the heeling apparatus 2 is provided in many configurations in which the bracket 50 can be removed with ease and no tools, while still not having to untie or remove laces of the outer shell 30. For example in various embodiments, the bracket is part of a cartridge-like assembly that slides in and out of the rear of the inner shell 10 and/or outer shell 30.

In various other embodiments, the heeling apparatus 2 is configured such that a portion of the rear of the outer shell 30 "peels" back relative to the inner shell 10, enabling removal of the bracket 50 without one having to completely slide out the inner shell 10 relative to the outer shell 30.

It should be further appreciated that in various embodiments, the heeling apparatus 2 comes in a configuration in which the inner shell 10 and outer shell 30 are molded as one piece and a portion of the lower portion of the heeling apparatus 2 is opened to allow removal of the bracket 50 and brake pad 70.

In further embodiments, the outer shell 30 and inner shell 10 are manufactured as separate components, but the outer shell 30 is cemented or glued to the inner shell 10 such that the bracket 50 and brake pad 70 are not removable.

In various other embodiments, the outer shell 30 is configured such that it has a sandal like appearance when being used independently as footwear relative to the inner shell 10. It should be appreciated that in various embodiments, either of the inner shell 10 and the outer shell 30 is configured to together or individually have the style of any suitable footwear.

In various embodiments, instead of using the plug 80 in a configuration in which the user is using the heeling apparatus 2 as a shoe, the bracket 50 is configured to be reversible, such that the side opposite the wheel mounting portion makes contact with the ground. In other words, the cavity 18 of the inner shell 10 is configured to house both the top and the bottom of the bracket 50.

It various embodiments, the heeling apparatus 2 is enhanced with suitable audio, video or lighting effects.

The heeling apparatus presented in the present disclosure provides a plurality of benefits. Among other qualities, the present heeling apparatus 2 provides: (i) a bracket 50 which is easily removable via the interlocking outer shell 30 and inner shell 10; (ii) an anatomical insole and novel bracket 50 which disperses pressure and enhances user comfort; (iii) the use of high-grade EVA material which absorbs shock and decreases the weight of the heeling apparatus 2; and (iv) customization ability via its interlocking construction, allowing for endless color combinations and replacement parts (bracket, wheel assembly, plug, brake pad, etc.).

It should be appreciated that the appearance of the structures of heeling apparatus 2 does not necessarily drive their function. In other words, the functions of the structures of heeling apparatus 2 may have a variety of appearances (i.e., shapes, sizes, etc.). For example, the ventilation openings could be various sizes and shapes, as could the openings in the bottom of the outer shell 30. Similarly the overall appearance or molding of the inner and outer shells could vary, with the heeling apparatus still accomplishing the same function.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A heeling apparatus comprising:

an inner shell defining a cavity at a bottom side thereof, the cavity being located in a heel section of the heeling apparatus;

an outer shell configured to interlock with the inner shell; and a removable bracket configured to be received by the cavity of the inner shell and held in place by the outer shell, wherein the removable bracket includes a mounting assembly configured to receive a wheel assembly, the removable bracket further having the wheel assembly mounted therein, wherein the heeling apparatus includes a brake pad that is removably mounted in the heeling apparatus between the inner shell and the outer shell so that a portion of the brake pad is in contact with both the inner shell and the outer shell, wherein the brake pad is engaged by the removable bracket such that brake pad extensions from the brake pad are positioned to extend downward and outward through respective brake pad openings in the outer shell.

2. The heeling apparatus of claim 1, wherein the inner shell includes at least one protrusion and the outer shell includes at least one receiving aperture.

3. The heeling apparatus of claim 2, wherein the at least one receiving aperture is configured to interlock with the at least one protrusion.

4. The heeling apparatus of claim 2, wherein the at least one protrusion includes one or more protrusions located at a heel of the inner shell.

5. The heeling apparatus of claim 4, wherein the at least one protrusion includes a protrusion located around an Achilles area of the inner shell.

6. The heeling apparatus of claim 5, wherein the outer shell includes a heel strap and the at least one receiving aperture, is defined by the heel strap and is configured to receive the at least one protrusion located at the Achilles area of the inner shell.

7. The heeling apparatus of claim 2, wherein the at least one protrusion includes a plurality of protrusions located at a sole of the inner shell.

8. The heeling apparatus of claim 7, wherein the plurality of protrusions at the sole of the inner shell are configured to interlock with a plurality of respective receiving apertures at a sole of the outer shell.

9. The heeling apparatus of claim 1, wherein at least one of the inner shell or the outer shell includes at least one ventilation opening.

10. The heeling apparatus of claim 1, wherein the wheel assembly is removable and is configured to be removed from the heeling apparatus mounting assembly without removal of the removable bracket.

11. The heeling apparatus of claim 1, wherein the removable bracket includes a plurality of vertical ribs.

12. The heeling apparatus of claim 1, wherein the cavity is reconfigurable with one of the removable bracket or a plug.

13. The heeling apparatus of claim 1, wherein the removable bracket is removable from the cavity downward, from the bottom side of the inner shell.

14. The heeling apparatus of claim 1, further comprising a shoe configuration wherein the removable bracket is not seated in the cavity of the inner shell and at least one additional configuration wherein the removable bracket is seated in the cavity of the inner shell.

* * * * *